US005879209A

United States Patent [19]

Jones

[11] Patent Number: 5,879,209

[45] Date of Patent: Mar. 9, 1999

[54] AUTOMATIC TRIM CONTROL SYSTEM FOR JET PROPELLED WATERCRAFT

[75] Inventor: James R. Jones, Neosho, Wis.

[73] Assignee: Brunswick Corporation, Lake Forest, Ill.

[21] Appl. No.: 910,892

[22] Filed: Aug. 13, 1997

[51] Int. Cl.[6] ..... B63H 11/113

[52] U.S. Cl. ..... 440/42; 440/47

[58] Field of Search ..... 440/1, 40, 42, 440/47

[56] References Cited

U.S. PATENT DOCUMENTS

| | | | |
|---|---|---|---|
| 3,776,173 | 12/1973 | Horwitz | 440/42 |
| 3,935,833 | 2/1976 | Onal | 115/12 R |
| 4,004,541 | 1/1977 | Onal | 115/12 R |
| 4,051,801 | 10/1977 | Woodfill et al. | 440/42 |
| 4,718,872 | 1/1988 | Olson et al. | 440/1 |
| 5,029,546 | 7/1991 | Olson | 114/151 |
| 5,184,966 | 2/1993 | Kobayashi et al. | 440/38 |
| 5,254,023 | 10/1993 | Kobayashi | 440/38 |
| 5,310,369 | 5/1994 | Kobayashi | 440/38 |
| 5,421,753 | 6/1995 | Roos | 440/43 |
| 5,437,568 | 8/1995 | Kobayashi | 440/42 |
| 5,474,007 | 12/1995 | Kobayashi | 440/42 |
| 5,507,672 | 4/1996 | Imaeda | 440/1 |
| 5,540,174 | 7/1996 | Kishi et al. | 114/291 |
| 5,551,898 | 9/1996 | Matsumoto | 440/41 |
| 5,579,711 | 12/1996 | Thomas | 114/285 |
| 5,683,275 | 11/1997 | Nanami | 440/47 |

FOREIGN PATENT DOCUMENTS

| | | | |
|---|---|---|---|
| 62-247997 | 10/1987 | Japan | 440/42 |
| 703421 | 12/1979 | U.S.S.R. | 440/42 |

*Primary Examiner*—Sherman Basinger
*Attorney, Agent, or Firm*—Andrus, Sceales, Starke & Sawall

[57] ABSTRACT

An automatic trim control system for a marine jet drive adjusts trim in response to water pressure in the jet drive duct immediately upstream of the impeller. The preferred system includes a mechanical actuator consisting of a spring biased link rod mounted to a resilient diaphragm located in an actuator housing. The diaphragm separates the chamber within the housing into a front portion and a rear portion. The front portion of the housing communicates through a water pressure tap line with the water pressure in the jet drive duct immediately upstream of the impeller. When the watercraft is traveling at high speeds on plane, water pressure in the jet drive duct is sufficient to push the diaphragm rearward against the spring biasing force, thus positioning the jet drive in a trim-up position. However, when the watercraft is accelerating at low speeds and the impeller is creating suction within the jet drive duct, water pressure within the front portion of the chamber of the actuator housing is insufficient to push the link rod against the spring biasing force and the jet drive remains in a trim-down position. Alternatively, a pressure sensor and an electronically controlled servomotor trim actuator can be used to carry out the invention.

6 Claims, 6 Drawing Sheets

AUTOMATIC TRIM CONTROL SYSTEM FOR JET PROPELLED WATERCRAFT

FIELD OF THE INVENTION

The invention relates to trim control for marine propulsion systems. The invention is especially well suited for automatically controlling the trim in a marine jet drive.

BACKGROUND OF THE INVENTION

Marine jet drives are used in many applications, including propulsion for personal watercraft and jet boats. Marine jet drives typically have an engine driven jet pump located within a duct in the hull of the watercraft. A jet of water exits the duct rearward of the watercraft to propel the watercraft. The jet pump generally consists of an impeller and a stator located within the duct followed by a nozzle. The impeller is driven by the engine and rotates within a wear ring which forms a portion of the duct. The rotating impeller provides thrust energy to the water flowing through the jet drive. The water then flows through the stator and the nozzle before exiting rearward through a generally tubular rudder that can be rotated about a vertical axis to steer the watercraft.

To improve acceleration at low speeds, it is often desirable to trim the tubular rudder downward. In other words, it is often desirable to rotate the tubular rudder downward about a horizontal trim axis so that the jet of water exiting rearward of the watercraft has a downward angle of discharge. The downward angle of discharge tends to hold the bow of the watercraft lower in the water as the watercraft transitions to on plane. Without trimming the jet drive downward, some hull configurations are likely to pitch up, which is not only unstable, but also reduces speed of acceleration.

The accelerating pitch for the watercraft can change dramatically depending on the weight in the watercraft, especially in personal watercraft.

The term "porpoising" is used in the art to describe oscillations of the longitudinal pitch attitude of the watercraft with respect to the surface of the water. Without trimming the jet drive downward, the watercraft bow will normally oscillate between a relatively high position and a relatively low position. The period of these oscillations can vary depending on the watercraft and conditions, but one cycle per second would be a typical rate of oscillation.

When the watercraft accelerates to the point that the watercraft is on plane, it is no longer desirable to trim the jet drive downward to the degree required for acceleration. When the watercraft is on plane, excess downward trim of the jet drive simply wastes thrust and compromises watercraft performance. The planing speed for watercraft normally changes with respect to the weight in the watercraft. For instance, in a personal watercraft having one person, the planing speed is typically about 15 mph. On the other hand, if two or three people are on the personal watercraft, the planing speed may be 20–25 mph. In addition, heavily loaded watercraft typically have a higher pitch attitude during low speed acceleration before the watercraft is on plane.

Both manual trim adjustment systems and automatic trim adjustment systems are known in the art. The invention is an improved automatic jet drive trim adjustment system.

BRIEF SUMMARY OF THE INVENTION

It has been found that water pressure characteristics in the marine jet drive upstream of the impeller are coincidental with trim requirements. The invention is an automatic trim control system for a marine jet drive that adjusts trim position in response to water pressure in the jet drive duct upstream of the impeller. The invention provides accurate automatic trim control because monitoring water pressure in the pump inlet automatically accounts for watercraft speed and load variations which both affect trim requirements.

Water pressure in the pump upstream of the impeller is a function of both watercraft speed and jet drive pumping force. Watercraft speed defines the velocity of water inputting the jet drive, and the jet drive pumping force discriminates between light loads and heavy loads. This is important because, as mentioned above, lightly loaded watercraft get on plane at lower speeds than heavily loaded watercraft, thus trim requirements between lightly loaded and heavily loaded watercraft are substantially different. When a watercraft is accelerating at low speeds before the watercraft is on plane, the pressure in the jet drive duct drops as impeller rotation speed increases to accelerate the watercraft. Under these conditions, the water pressure in the pump upstream of the impeller is negative (e.g. below atmospheric). As watercraft speed increases, water ram pressure begins to counteract the pressure drop upstream of the impeller. The pressure in the pump upstream of the impeller does not normally swing from negative to positive until a point after the hull is on plane. Therefore, the presence of positive pressure in the pump duct upstream of the impeller is coincidental with trim-up requirements. Since heavily loaded watercraft get on plane at higher speeds than lightly loaded watercraft, the delayed positive pressure in the pump upstream of the impeller for heavily loaded watercraft coincides nicely with additional trim-down requirements for heavily loaded watercraft.

In the preferred embodiment of the invention, the automatic trim control system consists of a pressure tap that communicates with water flowing through the jet drive duct upstream of the impeller, preferably immediately upstream of the impeller, and a mechanical trim actuator connected to the pressure tap line. The mechanical trim actuator has a link rod that is moved to rotate the tubular rudder about the horizontal trim axis by energy provided from the water pressure in the jet drive duct upstream of the impeller. The preferred mechanical trim actuator consists of a housing having an internal chamber defined by an enclosing sidewall structure and a front endwall and a rear endwall. A resilient diaphragm spans across the chamber in the housing to separate the chamber into a front portion and a rear portion. The pressure tap line is connected to an actuator housing to communicate with the front portion of the actuator housing chamber. A link rod is connected to the other side of the diaphragm and passes through the rear portion of the chamber and also through the rear endwall of the actuator housing. The other end of the link rod is connected to the tubular rudder preferably at a location below the horizontal trim axis. A spring provides biasing force against the diaphragm in the forward direction. The spring is preferably a compressed spring mounted over the link rod between the diaphragm and the rear endwall of the actuator housing. Before the watercraft is on plane, water pressure in the duct upstream of the impeller provides insufficient force to push the diaphragm rearward against the force of the spring. However, when the watercraft gets on plane, water pressure in the duct upstream of the impeller increases and pushes the diaphragm rearward against the force of the spring to move the link rod rearward and rotate the tubular rudder into a trim-up position. The strength of the spring can be chosen to optimize trim timing.

This preferred embodiment of the invention not only monitors water pressure in the duct inlet to accurately account for both watercraft speed and jet drive pumping force for optimum trim conditions, but also uses water pressure variations in the jet drive inlet to provide energy that mechanically actuates jet drive trimming.

The pressure tap is preferably mounted to communicate with water flowing through the wear ring in which the impeller rotates (i.e., immediately upstream of the impeller). Tests have shown that the most active pressure fluctuations during jet drive operation occur at the bottom of the wear ring. Therefore, placement of the pressure tap at the bottom of the wear ring provides the greatest overall pressure difference to drive the diaphragm, and also the best resolution for accurate timing.

In another embodiment of the invention, jet drive trim is actuated by a servomotor controlled by an electronic control unit. A pressure sensor is used to monitor the water pressure in the jet drive inlet upstream of the impeller. The pressure sensor transmits a signal to the electronic control unit. The electronic control unit controls the trim position of the jet drive in accordance with the pressure signal from the pressure sensor. In this embodiment of the invention, trim angle can be precisely controlled as a function of water pressure in the jet drive upstream of the impeller, however, water pressure fluctuations are not used to mechanically drive trim adjustments.

Other features and advantages of the invention may be apparent to those skilled in the art upon inspecting the following drawings and description thereof.

DETAILED DESCRIPTION OF THE INVENTION

Figure 1:
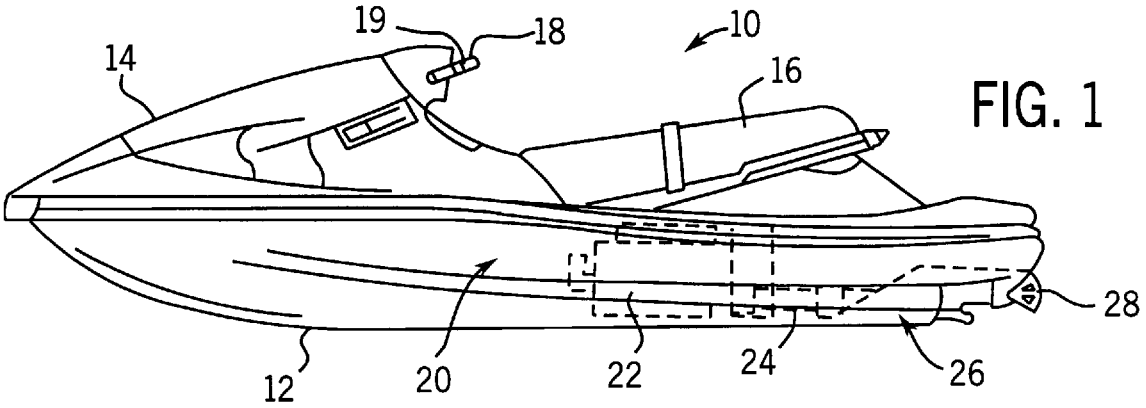
FIG. 1 is a schematic drawing of a personal watercraft.

FIG. 1 shows a personal watercraft. As previously mentioned, the invention has particular utility in small personal watercraft like the watercraft 10 depicted in FIG. 1, however, the invention is not limited thereto.

The personal watercraft 10 has a hull 12 and a deck 14, both preferably made of fiber reinforced plastic. A driver and/or passenger riding on the watercraft 10 straddles the seat 16. The driver steers the watercraft using a steering assembly 18 located forward of the seat 16. A throttle actuator 19 is normally mounted on the grip for the steering assembly 18.

An engine compartment 20 is located between the hull 12 and the deck 14. A gasoline-fueled internal combustion engine 22 is located within the engine compartment 20. The engine has an output shaft that is coupled via coupler 24 to a jet pump located rearward of the engine 22 generally in the vicinity of arrow 26.

Figure 2:
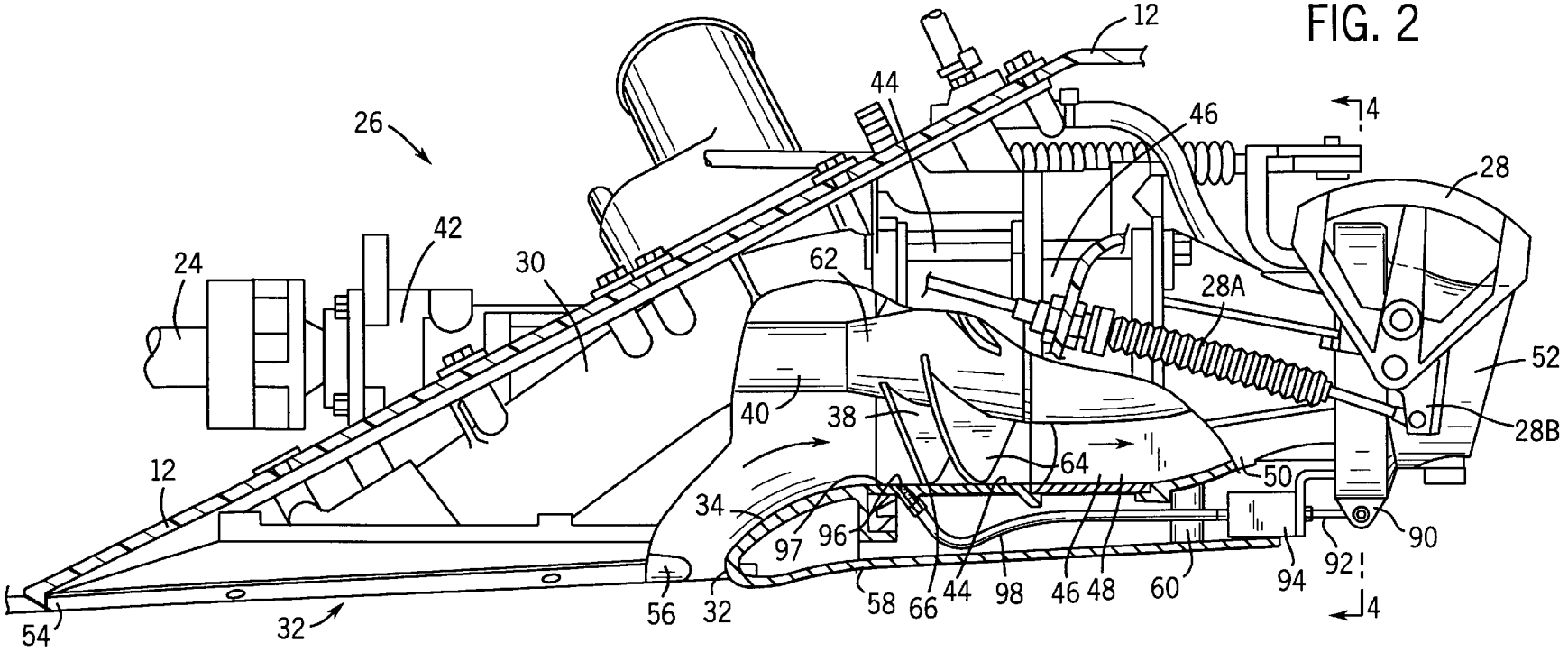
FIG. 2 is a side view of a jet drive for the personal watercraft shown in FIG. 1.

FIG. 2 shows a jet pump 26 implementing a mechanical trim control system in accordance with a preferred embodiment of the invention. The pump 26 includes an intake housing 30 that is attached to the hull 12. The intake housing 30 has an inlet opening 32 that provides a path for sea water to flow into an intake duct 34 located within the intake housing 30. Sea water flows upward and rearward through the intake duct to an impeller 38. The impeller is rotatably driven by an impeller drive shaft 40. The impeller drive shaft 40 passes through an impeller drive shaft opening 42 in the intake housing 30, and is coupled to engine output via coupler 24. As the impeller shaft 40 passes through the intake housing 30, the impeller shaft 40 is supported by a sealed bearing assembly. The preferred intake housing as well as the preferred sealed bearing assembly is described in detail in copending patent application Ser. No. 08/710,868, now U.S. Pat. No. 5,713,768, issued on Feb. 3, 1998 entitled "Intake Housing For Personal Watercraft", by James R. Jones, which is assigned to the assignee of the present application. The impeller 38 rotates within a wear ring 44 to accelerate sea water flowing through the jet pump 26. A stator 46 is located rearward of the impeller 38 and the wear ring 44. The stator 46 has several stationary vanes 48, preferably seven (7) vanes, to remove swirl from the accelerated sea water. After the sea water exits the stator 46, the water flows through a stationary nozzle 50. The preferred construction of the stator 46 and the nozzle 50 is described in detail in copending U.S. patent application Ser. No. 08/710,869, entitled "Stator And Nozzle Assembly For Jet Propelled Personal Watercraft," now U.S. Pat. No. 5,713,769, issued on Feb. 3, 1998 by James R. Jones, which is assigned to the assignee of the present application. As used herein, the term "jet drive duct" refers to the water flow passage defined by the combination of the intake duct 34, the wear ring 44, the stator 46, and the nozzle 50.

Sea water exiting the nozzle 50 is directed by rotating tubular rudder 52 about a vertical axis to steer the personal watercraft 10, and by rotating tubular rudder 52 about a horizontal axis to trim the jet drive 26. A reverse gate 28 is preferably mounted along a horizontal axis to rearwardly extending flanges on stationary nozzle 50. The reverse gate 28 is actuated by reverse gate control cable 28*a* which has an end connected to a flange 28*b* on the reverse gate 28. The reverse gate 28 is pivotally mounted to nozzle flanges 50*a*, FIG. 4. The preferred reverse gate mechanism is described in detail in copending patent application Ser. No. 08/783,440, now U.S. Pat. No. 5,752,864, issued on May 1, 1998 entitled "Reverse Gate For Personal Watercraft", by James R. Jones, Peter P. Grinwald and Richard P. Christians, which is assigned to the assignee of the present application.

Still referring to FIG. 2, an inlet adapter plate 54 is connected to the intake housing 30 upstream of the intake duct 34 to adapt intake housing 30 to the hull 12 on the underside of the watercraft 10. A tine assembly has a plurality of tines 56 that extend rearward from the inlet adapter 54 to cover the inlet opening 32. A ride plate 58 is mounted to the inlet adapter 54 rearward of the inlet opening 32. The ride plate 58 covers the area rearward of the inlet opening 32 to the transom of the watercraft 10 so that the pump components are not exposed below the watercraft 10. The ride plate 58 is supported in part by a depending boss 60 on the nozzle 50. The preferred inlet adapter system, including the inlet adapter plate 54, the tine assembly 56, and the ride plate 58 are disclosed in detail in copending patent application Ser. No. 08/717,915, now U.S. Pat. No. 5,700,169, issued on Dec. 23, 1997 entitled "Inlet Adapter For A Personal Watercraft", by James R. Jones, which is assigned to the assignee of the present application.

The impeller 38 has a hub 62 and blades 64 which extend outward from the impeller hub 62. Preferably, the impeller 38 has three or four blades 64. The impeller blades 64 should be equally spaced and the impeller 38 should be balanced. The impeller hub 62 has an outer surface that diverges as the surface extends rearward. The impeller blades 64 angle rearward as the blades 70 extend partially around the hub 38. Each blade 64 typically extends more than one quarter around the hub 38. An outer edge 66 of each impeller blade 64 is in close proximity with the inner surface of the wear ring 44. Both the impeller 38 and the wear ring 44 are preferably made of stainless steel. The preferred method of mounting impeller 38 to impeller shaft 40 is described in detail in copending patent application Ser. No. 08/719,621, now U.S. Pat. No. 5,759,074, issued on Jun. 2, 1998 entitled "Impeller Mounting System For A Personal Watercraft", by James R. Jones, which is assigned to the assignee of the present application.

The water pressure in the jet drive duct upstream of the impeller 38 depends both on watercraft 10 speed and impeller 38 rotation speed. When the watercraft 10 is accelerating at low speeds before the watercraft is on plane, the pressure in the jet drive duct upstream of the impeller 38 is small or typically negative with respect to atmospheric pressure due to impeller 38 suction.

Figure 3A:
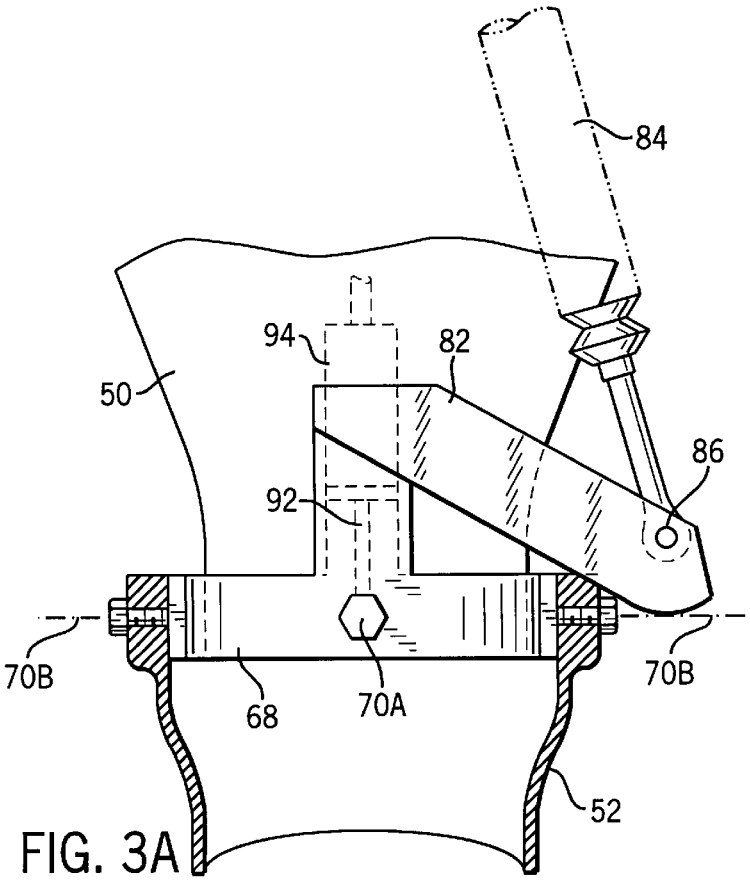
FIGS. 3*a* and 3*b* illustrate operation of the steering mechanism of the jet drive shown in FIG. 2.
Figure 3B:
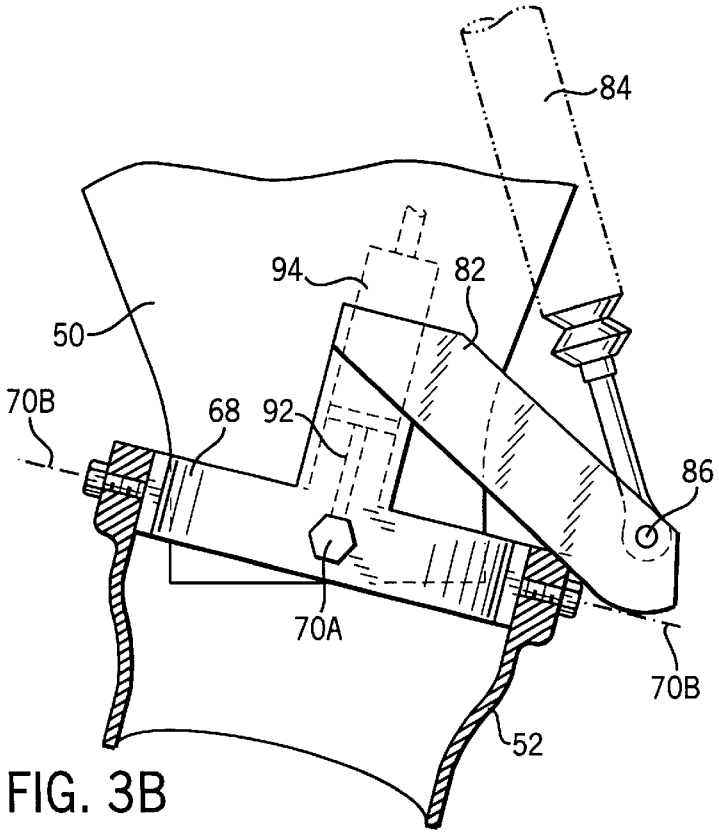
Figure 4:
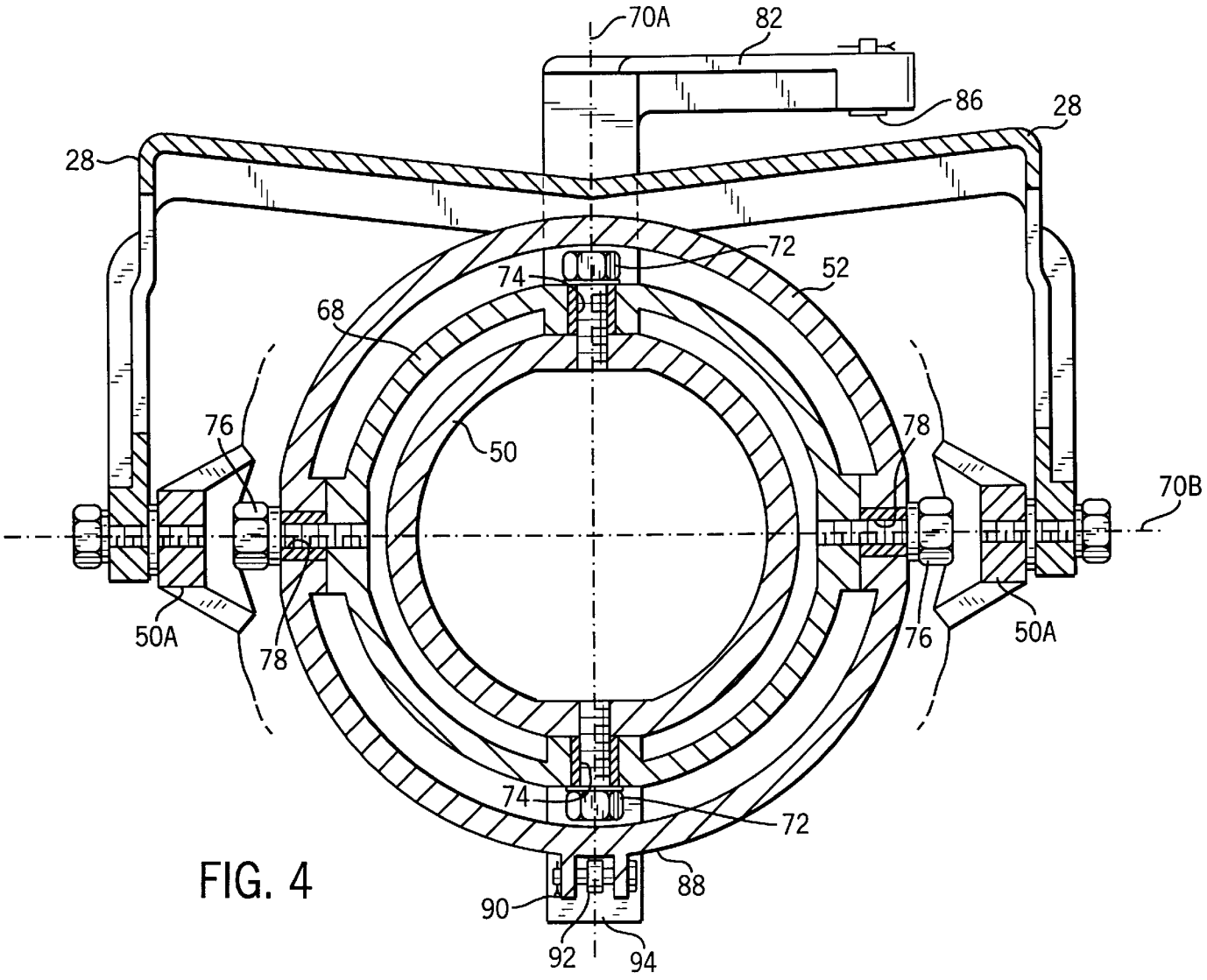
FIG. 4 is a sectional view taken along line 4—4 in FIG. 2 showing structure that enables a tubular rudder for the jet drive shown in FIG. 2 to be rotated about a vertical steering axis and also rotated about a horizontal trim axis.

Referring now to FIGS. 3*a*, 3*b* and FIG. 4, the tubular rudder 52 is mounted to the stationary jet drive nozzle 50 along a vertical steering axis 70*a*, and also along a horizontal trim axis 70*b*. In particular, a steering gimbal 68 is pivotally mounted to the stationary nozzle 50 along the vertical steering axis 70*a*. FIG. 4 shows the steering gimbal 68 being mounted to the stationary nozzle 50 with mounting bolts 72 passing through vertically disposed bushings 74 in the steering gimbal 68. The mounting bolts 72 secure in the stationary nozzle 50 along the vertical axis 70*a*.

The tubular rudder 52 is pivotally mounted to the steering gimbal 68 along the horizontal trim axis 70*b*. FIG. 4 shows mounting bolts 76 passing through horizontally disposed bushings 78 in the tubular rudder 52. The mounting bolts 76 are secured in the steering gimbal 68 along the horizontal axis 70*b*.

A steering flange 82 on the steering gimbal 68 is connected to steering cable 84. When the driver of the watercraft 10 steers the watercraft by turning the steering assembly 18, the end 86 of the steering cable 84 connected to the steering flange 82 on the steering gimbal 68 moves linearly to pivot the steering gimbal 68 and the tubular rudder 52 about the vertical steering axis 70*a*.

In accordance with the preferred embodiment of the invention, a bottom surface 88 of the tubular rudder 52 includes a trim flange 90 to which a link rod 92 from a trim actuator 94 is mounted. The trim actuator 94 moves the link rod 92 fore and aft to rotate the tubular rudder 52 about the horizontal trim axis 70*b*.

Referring now to FIG. 2, an access hole 96 is preferably located through the bottom wall 97 of the wear ring 44 immediately upstream of the impeller 38. Various fittings or the like may be used to install the access hole 96, however, it is preferred that the access hole 96 be a cylindrical hole through the wear ring 44 having a diameter of approximately 0.125 inches. A pressure tap line 98 is connected to the access hole 96 fitting at one end. The pressure tap line 98 extends rearward from the access hole 96 between the jet drive and the ride plate 58 to the automatic trim actuator 94. The automatic trim actuator 94 is exposed to the water pressure in the intake duct 34 immediately upstream of the impeller 38. In the embodiment of the invention shown in FIGS. 1 through 8, the automatic trim actuator 94 is a mechanical trim actuator.

When the watercraft 10 is accelerating at low speeds before the watercraft is on plane, the water pressure in the jet drive duct is near or even below atmospheric pressure due to suction created by the rotation of impeller blades 64. As watercraft speed increases during acceleration, and the watercraft gets on plane, water ram pressure into the intake duct increases upstream of the impeller 38. In the embodiment of the invention shown in FIG. 2, the change in water pressure at the access hole 96 at the bottom 97 of the wear ring 44 can be substantial as watercraft speed changes. For instance, negative 8 psi (atmospheric) at low speeds and high throttle, and 12 psi (atmospheric) for the watercraft on plane at high speeds.

Figure 5:
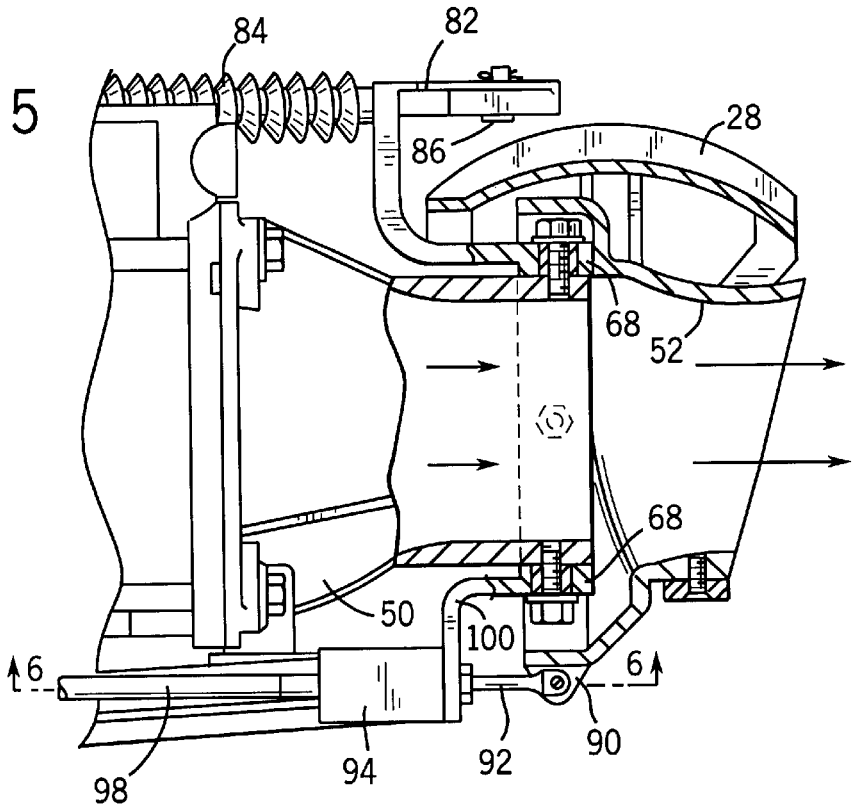
FIG. 5 is a detailed view showing the jet drive of FIG. 2 in a trim-up position.
Figure 6:
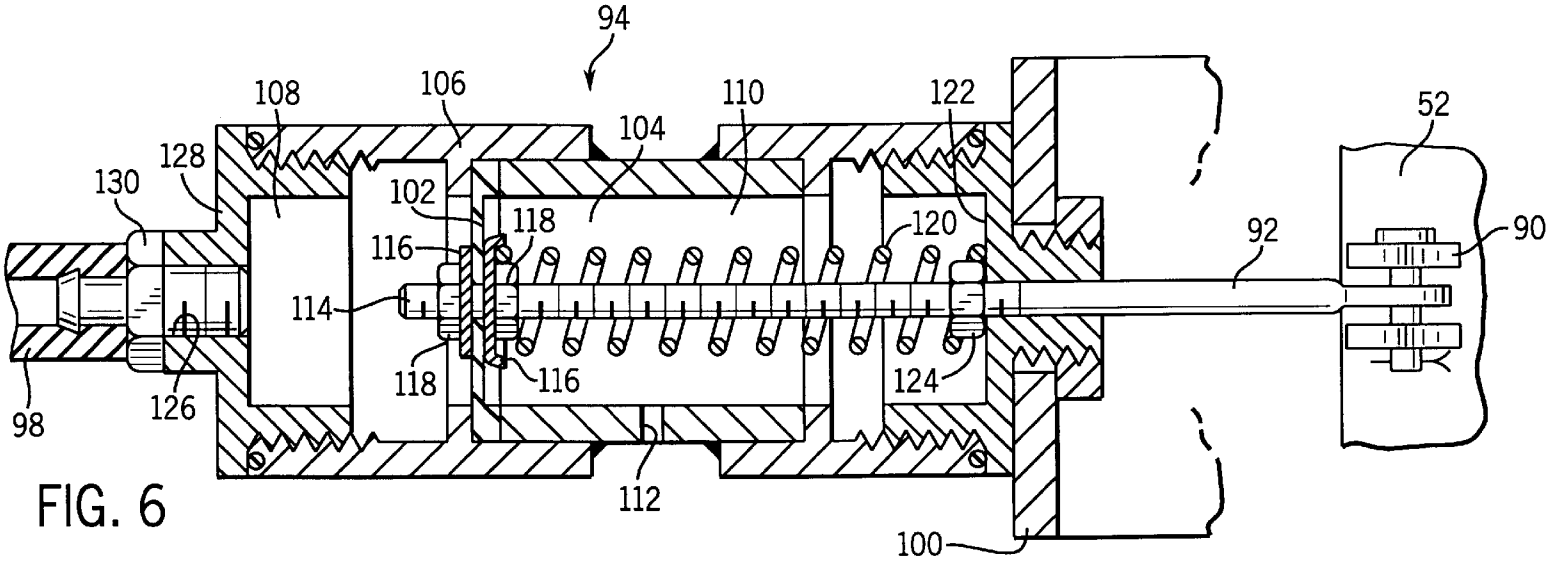
FIG. 6 is a view taken along line 6—6 in FIG. 5 detailing the structure of the mechanical trim actuator in a trim-up position.

Referring now to FIGS. 5 and 6, the mechanical trim actuator 94 is mounted to an actuator mounting flange 100 extending forward from the steering gimbal 68. The mechanical trim actuator 94 thus rotates about the vertical steering axis in sync with the steering gimbal 68. FIG. 5 shows the tubular rudder 52 in a trim-up position.

FIG. 6 is a view showing the detailed configuration of the mechanical trim actuator 94 in the trim-up position. As shown in FIG. 6, the mechanical trim actuator 94 comprises a resilient diaphragm 102 spanning across an internal chamber 104 of an actuator housing 106. The resilient diaphragm 102 is secured around its perimeter to the actuator housing 106 to seal a front portion of the internal chamber 104 within the actuator housing 106 from a rear portion 110 of the internal chamber 104 in the actuator housing 106. The rear portion 110 of the internal chamber 104 includes a drain 112. A front end 114 of the link rod 92 is connected to the resilient diaphragm 102 using washers 116 and nuts 118. A compressed spring 120 is mounted over the link rod to provide a biasing force against the diaphragm 102 in the forward direction. In FIG. 6, the compressed spring 120 pushes against the diaphragm 102 at the front end of the spring 120 and against a rear wall 122 of the actuator housing 106 at the other end of the spring 120. A trim position stop in the form of nut 124 on link rod 92 is located along the link rod 92 to limit rearward axial movement of the link rod 92 by physically engaging the rear wall 122 of the actuator housing 106.

A water pressure inlet hole 126 is provided through a front wall 128 of the actuator housing 106. Fitting 130 is used to connect pressure tap line 98 to the water pressure inlet hole 126 so that water in the water pressure tap line 98 communicates with water in the front portion 108 of the internal chamber 104 in the actuator housing 106. Thus, the water pressure within the front portion 108 of the internal chamber 104 in the actuator housing 106 is the same or nearly the same as the water pressure in the water pressure tap line 98 which in turn is the same or nearly the same as the water pressure within the intake duct 34 immediately upstream of the impeller 38 at the bottom of the wear ring 44. FIG. 6 illustrates a situation in which the pressure in the front portion of the internal chamber 104 of the actuator housing 106 is sufficient to push the resilient diaphragm 102 rearward against the biasing force of the spring 120. Under these conditions, the water pressure within the intake duct 34 is high, indicating that it is desirable that the tubular rudder 52 be in the trim-up position, FIG. 5, and the link rod 92 is moved axially rearward to position the tubular rudder 52 in the trim-up position, FIG. 5.

Figure 7:
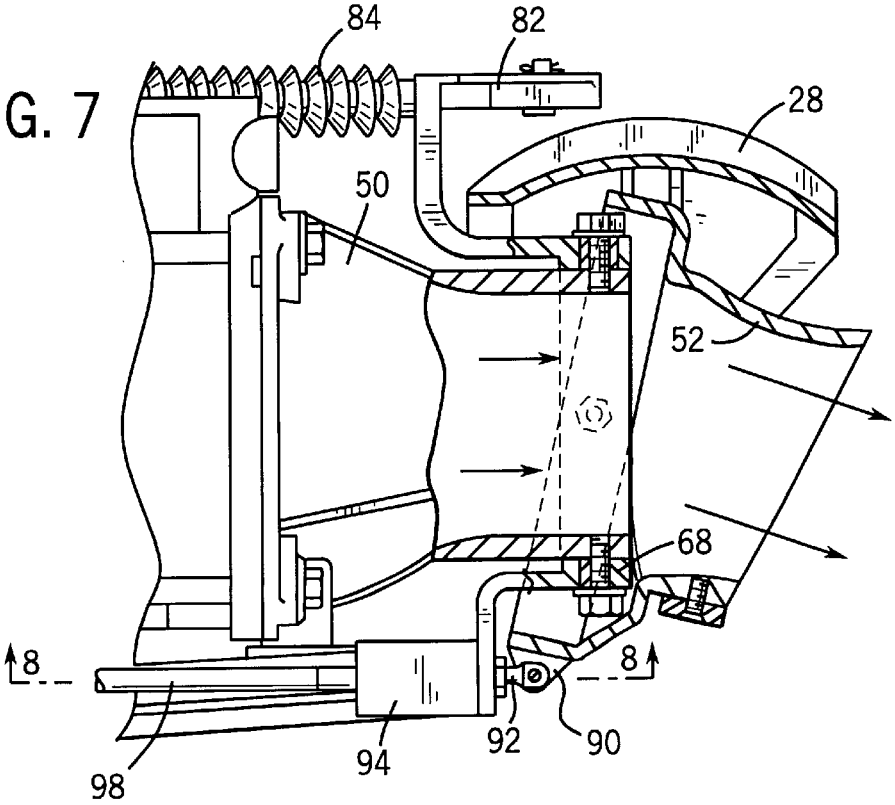
FIG. 7 is a detailed view of the jet drive in a trim-down position.
Figure 8:
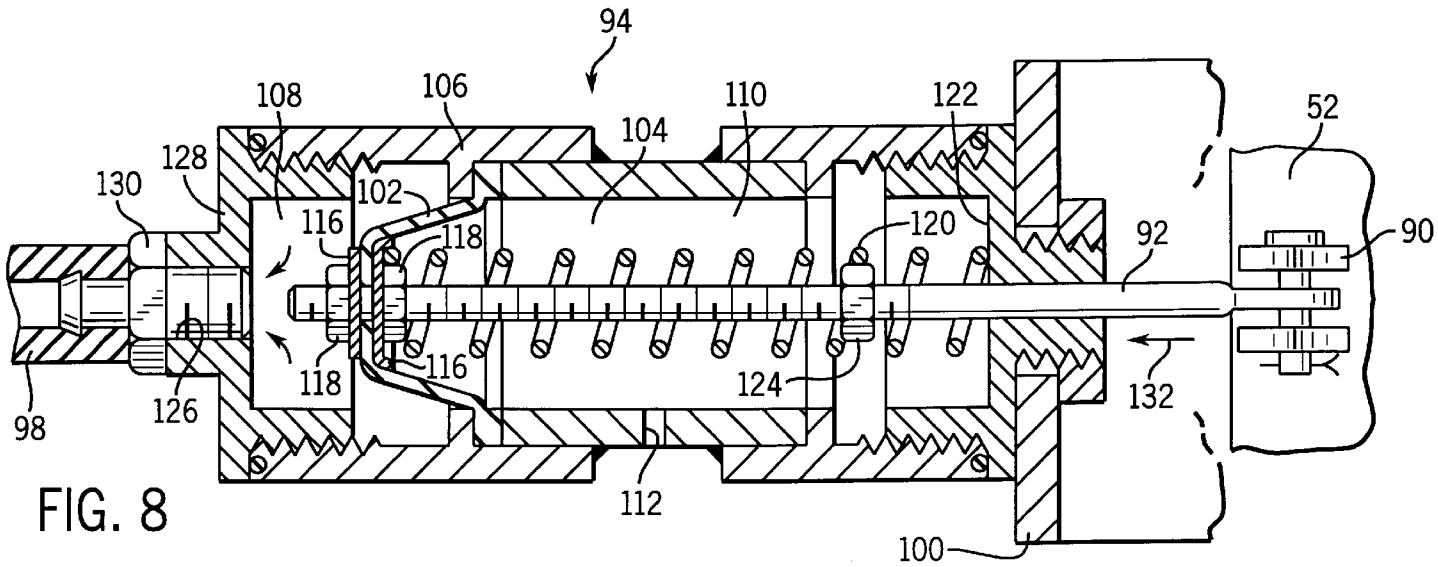
FIG. 8 is a view taken along line 8—8 in FIG. 7 detailing the mechanical actuator in a trim-down position.

FIGS. 7 and 8 show circumstances in which water pressure in the front portion 108 of the internal chamber 104 in the actuator housing 106 is insufficient to overcome the biasing force of the compressed spring 120. Under these conditions, the link rod 92 moves axially forward (arrow 132, FIG. 8). The link rod 92 pulls the trim flange 90 on the tubular rudder 52 forward to trim the tubular rudder 52 downward, FIG. 7. Thus, when the water pressure in the jet drive duct immediately upstream of the impeller 38 is insufficient to push the diaphragm 102 rearward against the spring 120 bias force, the spring 120 pushes the link rod 92 forward to pull the tubular rudder 52 into a trim-down position.

In the embodiment of the invention shown in FIGS. 2–8, the water pressure in the jet drive duct immediately upstream of the impeller 38 not only provides an indication of proper trim position, but also provides the energy to properly actuate the mechanical trim actuator 94.

Figure 9:
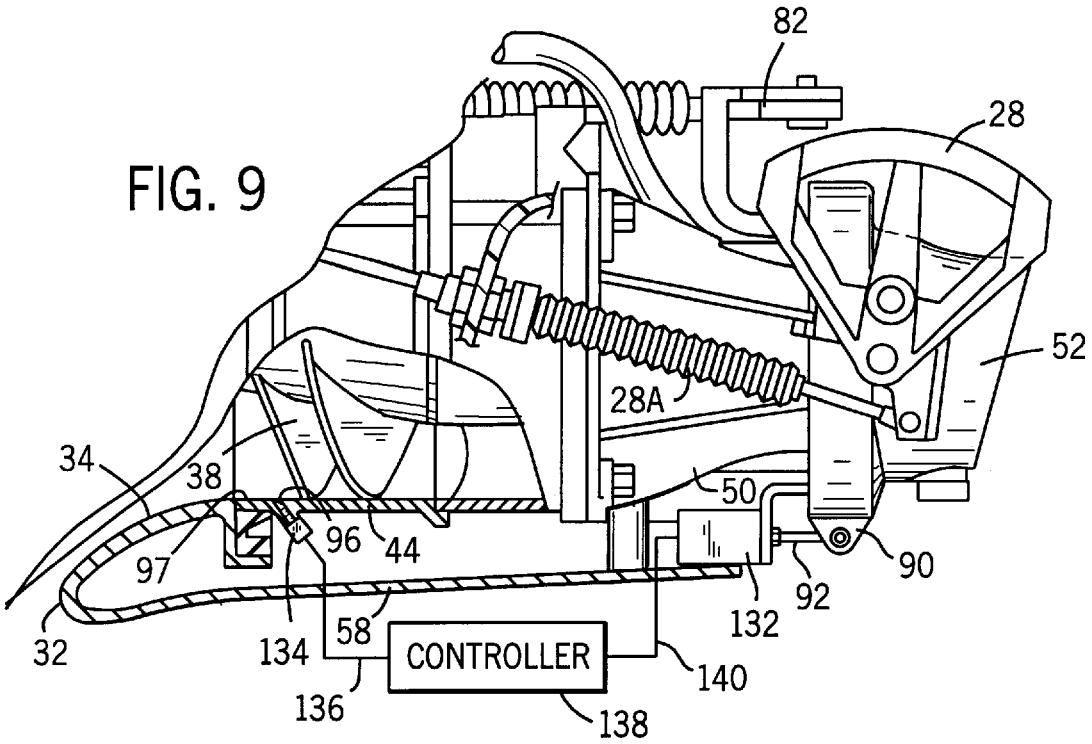
FIG. 9 is a schematic drawing illustrating a second embodiment of the invention.

FIG. 9 illustrates a second embodiment of the invention in which a servomotor-driven trim actuator 132 is used to trim the jet drive. In FIG. 9, a pressure sensor 134 measures the water pressure of water flowing through the jet drive duct immediately upstream of the impeller 38. The pressure sensor 134 is preferably a mechanically actuated diaphragm-type sensor mounted to the fitting for the access hole 96 through the bottom 97 of the wear ring 44. The diaphragm for the mechanical pressure sensor 134 is exposed to water flowing through the jet drive duct immediately upstream of the impeller 38, and generates a water pressure signal in response to the measured water pressure. The water pressure signal is transmitted to an electronic controller 138 as depicted by line 136. The electronic controller controls the servomotor-driven trim actuator 132 as depicted by line 140. The electronic controller 138 is preferably programmed to maintain the tubular rudder 52 in a trim-down position when the water pressure in the jet drive duct immediately upstream of the impeller 38 is below a threshold water pressure value, and in a trim-up position when the water pressure in the jet drive duct immediately upstream of the impeller exceeds the threshold value. In the system shown in FIG. 9 with the electronic controller 138, it may also be desirable to employ intermediate trim settings.

The foregoing description is a description of the preferred embodiments of the invention as installed in a personal watercraft. It should be readily apparent to those skilled in the art that the invention has utility on marine jet drives in other applications. For instance, the invention may be used in marine jet drives for larger watercraft, in jet drives having vertically mounted impellers, and in high-bred marine propulsion systems. Also, it is recognized that other alternatives, modifications and equivalents of the invention may also be possible in accordance with the true spirit of the invention. For example, in the mechanical actuator embodiment, the diaphragm actuator can be replaced with a slave cylinder/piston arrangement. Such modifications, alternatives and equivalents should be considered to fall within the scope of the following claims.

I claim:

1. A jet propelled watercraft comprising:

an engine;

a watercraft jet drive including a duct and an impeller located within the duct;

a jet drive water inlet on the underside of the watercraft that provides an opening for water to flow through the duct to the impeller, the impeller being driven by the engine to provide thrust energy to the flow of water through the duct;

a jet drive water outlet that provides an opening for water to flow from the jet drive rearward of the watercraft after the impeller has provided thrust energy to the flow of water through the duct;

a tubular rudder that redirects the direction of water flowing from the jet drive outlet, the tubular rudder being pivotally attached to the jet drive about a vertical steering axis and also pivotally attached to the jet drive about a horizontal trimming axis;

a pressure tap line communicating with water flowing through the duct upstream of the impeller; and a mechanical trim actuator connected to the pressure tap line that rotates the tubular rudder about the horizontal trim axis in response to water pressure within the pressure tap;

wherein the mechanical trim actuator comprises:

an actuator housing having an internal chamber defined by an enclosing sidewall structure, a front endwall and a rear endwall;

a diaphragm that spans across the chamber to separate the chamber into a front portion and a rear portion;

an actuator inlet passing through the front endwall into the front portion of the internal chamber in the actuator housing, the inlet being connected to the pressure tap line that communicates with the water flowing through the duct upstream of the impeller; and a link rod passing through the rear portion of the internal chamber of the actuator housing and through the rear endwall of the actuator housing, an internal end of the link rod being connected to the diaphragm so that an internal end of the link rod moves to rotate the rudder about the horizontal trim axis when the diaphragm inside the actuator housing moves in response to the pressure in the pressure tap line.

2. A jet propelled watercraft as recited in claim 1 further comprising a spring biasing the diaphragm towards the front endwall of the mechanical trim actuator.

3. A jet propelled watercraft as recited in claim 2 wherein the spring is mounted over the link rod between the diaphragm and the rear endwall of the mechanical trim actuator housing.

4. A jet propelled watercraft as recited in claim 2 wherein the strength of the spring is selected so that the diaphragm begins to move the link rod against the force of the spring when the water pressure in the water pressure tap line corresponds to the speed and load conditions in which it is desirable to move the tubular rudder to a trim-up position.

5. A jet propelled watercraft as recited in claim 1 wherein a trim position stop is mounted on the link rod within the actuator housing, and rearward axial movement of the link rod is limited by the trim position stop when the trim position stop engages the rear endwall of the actuator housing.

6. A jet propelled watercraft as recited in claim 1 wherein the external end of the link rod is connected directly to the tubular rudder below the horizontal trim axis.

* * * * *